US006679389B1

(12) United States Patent
Robertson et al.

(10) Patent No.: US 6,679,389 B1
(45) Date of Patent: Jan. 20, 2004

(54) FRONT PIECE FOR A MERCHANDISING DISPLAY TRACK DEVICE

(75) Inventors: James David Robertson, Atlanta, GA (US); Ming Sun, Roswell, GA (US)

(73) Assignee: Display Industries, LLC, Norcross, GA (US)

( * ) Notice: Subject to any disclaimer, the term of this patent is extended or adjusted under 35 U.S.C. 154(b) by 0 days.

(21) Appl. No.: 10/207,319

(22) Filed: Jul. 29, 2002

(51) Int. Cl.[7] ..... A47F 5/00

(52) U.S. Cl. ..... 211/59.2; 211/183; 211/74; 312/45; 312/72

(58) Field of Search ..... 211/59.2, 74, 183, 211/59.3; 312/72, 45

(56) References Cited

U.S. PATENT DOCUMENTS 4,598,828 A * 7/1986 Young et al. ..... 211/59.2
5,240,126 A * 8/1993 Foster et al. ..... 211/59.3
5,531,336 A * 7/1996 Parham et al. ..... 211/183
5,645,176 A * 7/1997 Jay ..... 211/59.2
5,665,304 A * 9/1997 Heinen et al. ..... 312/71
5,685,664 A * 11/1997 Parham et al. ..... 403/393
5,695,074 A * 12/1997 Wiese ..... 211/59.2
5,706,957 A * 1/1998 Hardy ..... 211/59.2
5,788,091 A * 8/1998 Robertson et al. ..... 211/59.2
5,971,204 A * 10/1999 Apps ..... 221/92
6,068,139 A * 5/2000 Brozak, Jr. ..... 211/59.2
6,068,142 A * 5/2000 Primiano ..... 211/183
6,082,556 A * 7/2000 Primiano et al. ..... 211/59.2
6,142,316 A * 11/2000 Harbour et al. ..... 211/59.2
6,189,734 B1 * 2/2001 Apps et al. ..... 221/193
6,237,784 B1 * 5/2001 Primiano ..... 211/59.2
6,325,221 B2 * 12/2001 Parham ..... 211/59.2
6,513,667 B2 * 2/2003 Battaglia et al. ..... 211/59.2
2001/0002658 A1 * 6/2001 Parham ..... 211/59.2
2001/0020606 A1 * 9/2001 Battaglia et al. ..... 211/59.2

* cited by examiner

*Primary Examiner*—Daniel P. Stodola
*Assistant Examiner*—Jennifer E. Novosad
(74) *Attorney, Agent, or Firm*—John L. James

(57) ABSTRACT

A front panel for a display rack has a base, upstanding sidewalls connected along their bottom end portions to the base, face members connected to the front edges of the sidewalls, and an elongate connecting member connected to the top end portions of the face members. The base, face members and connecting member define a viewing window for the display rack through which a beverage container in a display rack in a refrigerator can be viewed. The base and connecting member curve outward to position a beverage container forward in the display rack. A pair of downwardly extending fingers fit into receiving slots in a front segment of the rack to fasten the front panel to the front segment of the display rack.

11 Claims, 6 Drawing Sheets

FRONT PIECE FOR A MERCHANDISING DISPLAY TRACK DEVICE

TECHNICAL FIELD OF THE INVENTION

This invention relates generally to a adjustable length track device for a merchandising display shelf, and, more particularly, to a front piece for such a track device.

BACKGROUND OF THE INVENTION

Display racks are used to shelve merchandise awaiting purchase by a consumer. Some items, such as beverages, are best when consumed chilled, and are consequently shelved in a refrigerator. Display racks are used in the refrigerator to keep beverage containers upright for easy viewing and to separate them for dispensing one at a time. Beverages are removed one at a time from the front of the rack and the remaining inventory is urged to the front of the rack by gravity or a pusher mechanism. Restocking conveniently occurs from the rear of the rack ensuring that beverages are chilled when they reach the front of the rack. The front of the rack is important for presentation of the beverage. Accordingly, it will be appreciated that it would be highly desirable to have a display rack that promotes easy dispensing of beverage containers and promotes easy viewing of beverage container labeling.

A display rack unit is assembled from multiple track devices for merchandising articles such as bottled on canned drink products. The display rack unit includes a plurality of elongated track devices interconnected, often detachably interconnected, in side-by-side relationship. The number of track devices used to assemble the display rack unit is determined such that the size of the unit is suitable for placement onto an existing display shelf in a retail environment to fill the width of the shelf.

Track devices require a stop member on the front which is referred to as a front piece. An ideal front piece stops the forward motion of the articles to prevent inadvertent removal while allowing intentional removal by a purchaser, and provides a window for easily viewing the product label. A problem with the front piece is attaching it to the body of the display shelf. Some front pieces are integrally formed with the body as a single unit, but the intricate molds required increase manufacturing complexity and cost. Detachable font pieces present a problem also because it sometimes breaks or becomes deformed while being installed due to complicated fastening mechanisms. It will be appreciated that it would be highly desirable to have an adjustable track device with a front piece that is easy to attach and detach.

SUMMARY OF THE INVENTION

The present invention is directed to overcoming one or more of the problems set forth above. Briefly summarized, according to one aspect of the present invention, a front panel for a display rack comprises a base, upstanding sidewalls connected along their bottom end portions to the base, face members connected to the front edges of the sidewalls, and an elongate connecting member connected to the top end portions of the face members. The base, face members and connecting member define a viewing window for the display rack through which a beverage container in a display rack in a refrigerator can be viewed. The base and connecting member curve outward to position a beverage container forward in the display rack for easy removal. A pair of downwardly extending fingers slip into receiving slots in the front segment to fasten the front panel to the front segment of the display rack.

These and other aspects, objects, features and advantages of the present invention will be more clearly understood and appreciated from a review of the following detailed description of the preferred embodiments and appended claims, and by reference to the accompanying drawings

DETAILED DESCRIPTION OF THE PREFERRED EMBODIMENTS

Figure 1:
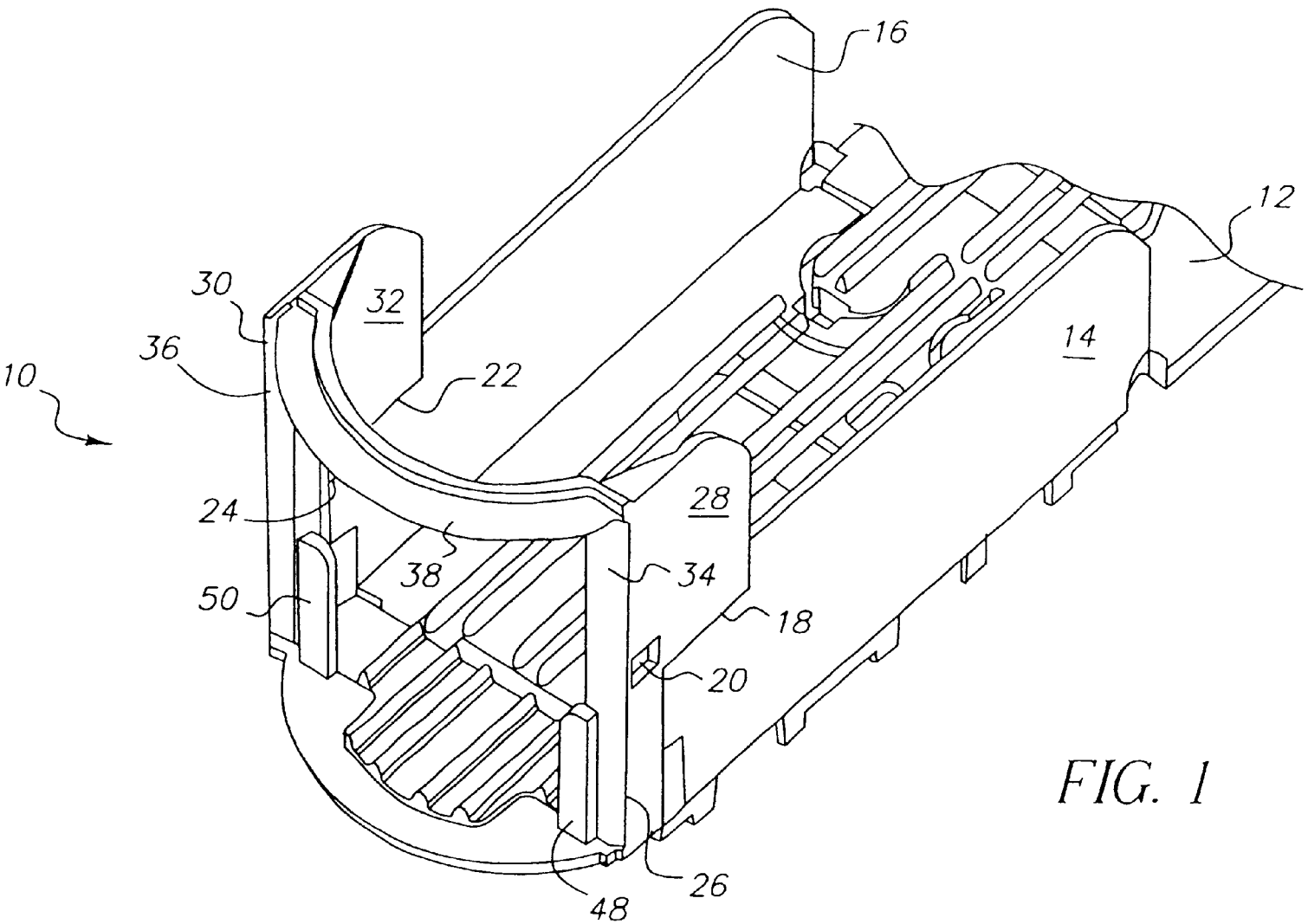
FIG. 1 is a perspective view of a preferred embodiment of a front piece attached to a front segment of a track device according to the present invention.
Figure 2:
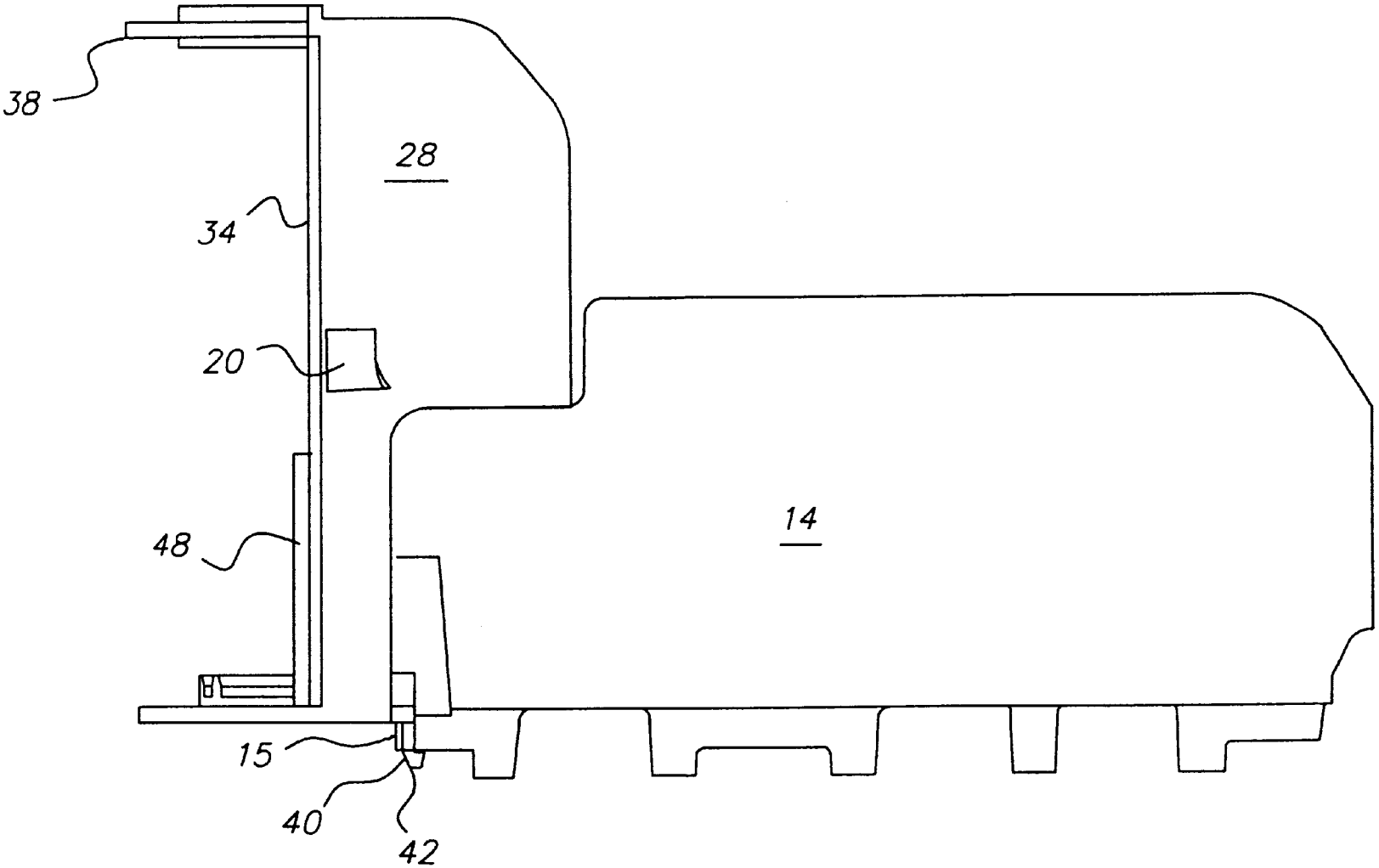
FIG. 2 is a side view of the track device of FIG. 1.
Figure 3:
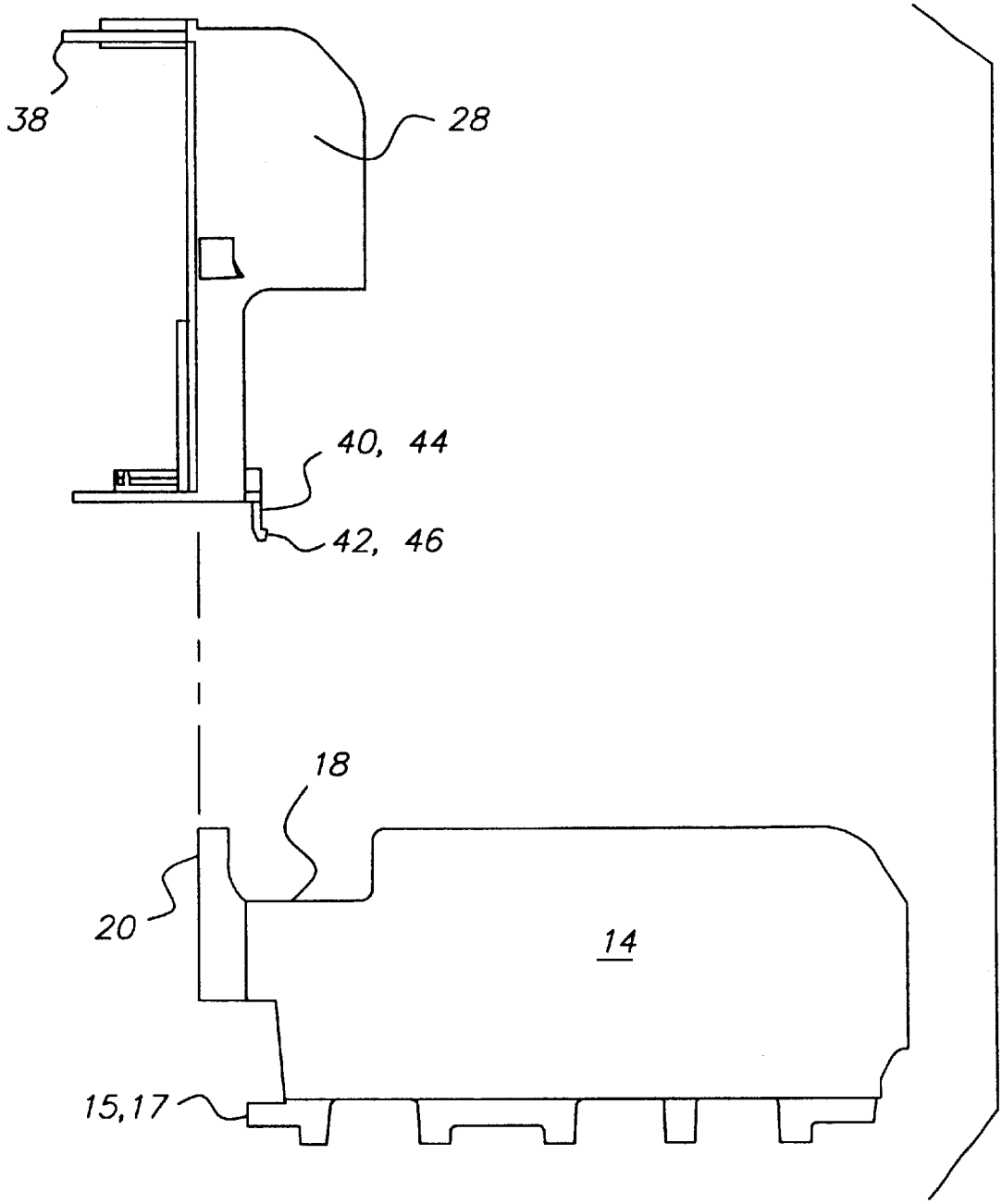
FIG. 3 is a side view similar to FIG. 2 but showing the front piece detached from the front segment.
Figure 4:
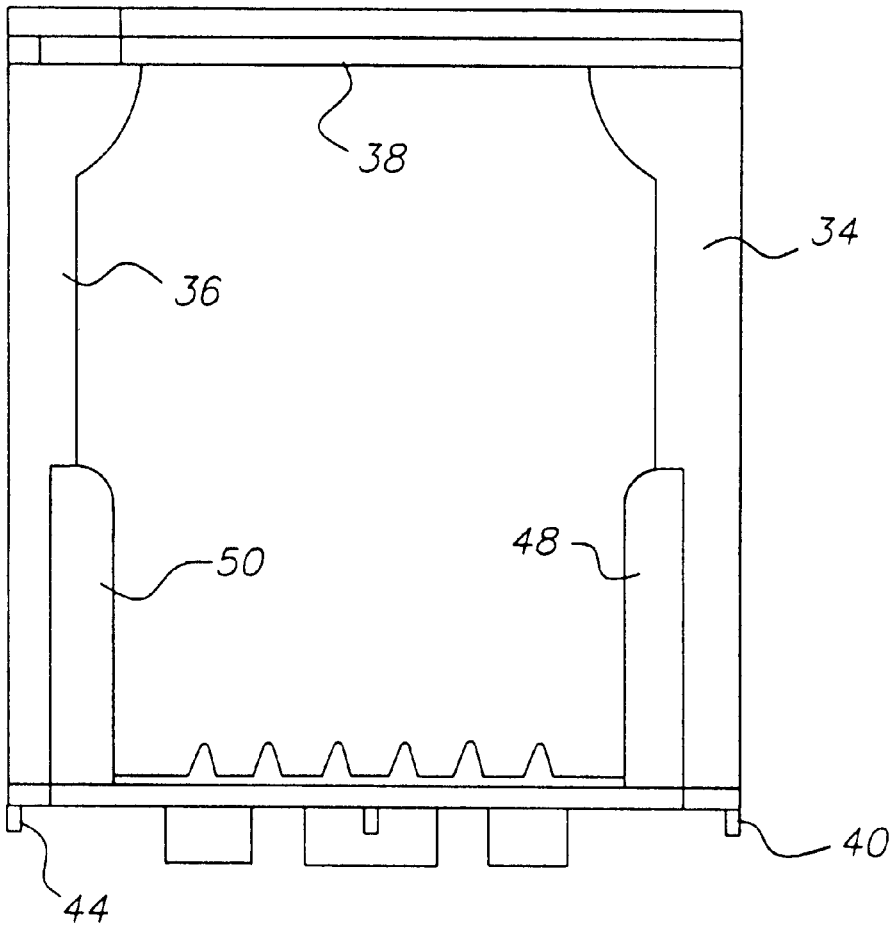
FIG. 4 is a front view of the front piece of FIG. 1.

Referring to FIGS. 1–5, a display rack unit assembled from multiple track devices is designed to merchandise articles such as bottled or canned drink products. The display rack unit includes a plurality of elongated track devices interconnected in side-by-side relationship. The number of track devices used to assemble the display rack unit is determined such that the size of the unit is suitable for placement onto an existing display shelf in a retail environment. Adjacent tracks may be formed as a single unit, or the interconnection of two adjacent track devices may be achieved by connecting means such as connector slots cooperating horizontal connector elements. Track devices and connector elements are more fully described in U.S. Pat. No. 5,634,564, which issued Jun. 3, 1997 to Spamer et al., the disclosure of which is incorporated herein by reference.

Referring to FIGS. 1–4, there is illustrated a front panel assembly 10 for an elongated display track device 12. Display track device 12 is composed of a number of sections or segments that are frangibly connected end-to-end to one another. Such track devices are more fully described in co-pending application Ser. No. 09/999,317 filed Oct. 31, 2001,now U.S. Pat. No. 6,615,995, the disclosure of which is incorporated herein by reference. Front panel assembly 10 is preferably a unitary structure constructed of plastic using an injection molding process, but may be constructed of other materials.

A front track segment of track device 12 has a floor or base wall with opposed upstanding sidewalls 14, 16 forming a channel for a single row of articles to slide along between the sidewalls 14, 16. The front track segment has a front end portion that will be disposed at the front of the display shelf and a rear end portion that defines a keyway or other means for connecting to an intermediate track segment or a rear track segment. The right sidewall panel 14 defines a notch 18 and an upstanding protrusion or arm 20. The front track segment defines a slot 15 below right sidewall panel 14. The slot 15 is preferably formed of a three sided loop of material attached to the base wall to accept a member forced into it. Similarly, the left sidewall panel 16 defines a notch 22 and an upstanding protrusion or arm 24. The front track segment defines a slot 17 below left sidewall panel 16 similar to the slot below the right sidewall panel.

Figure 5:
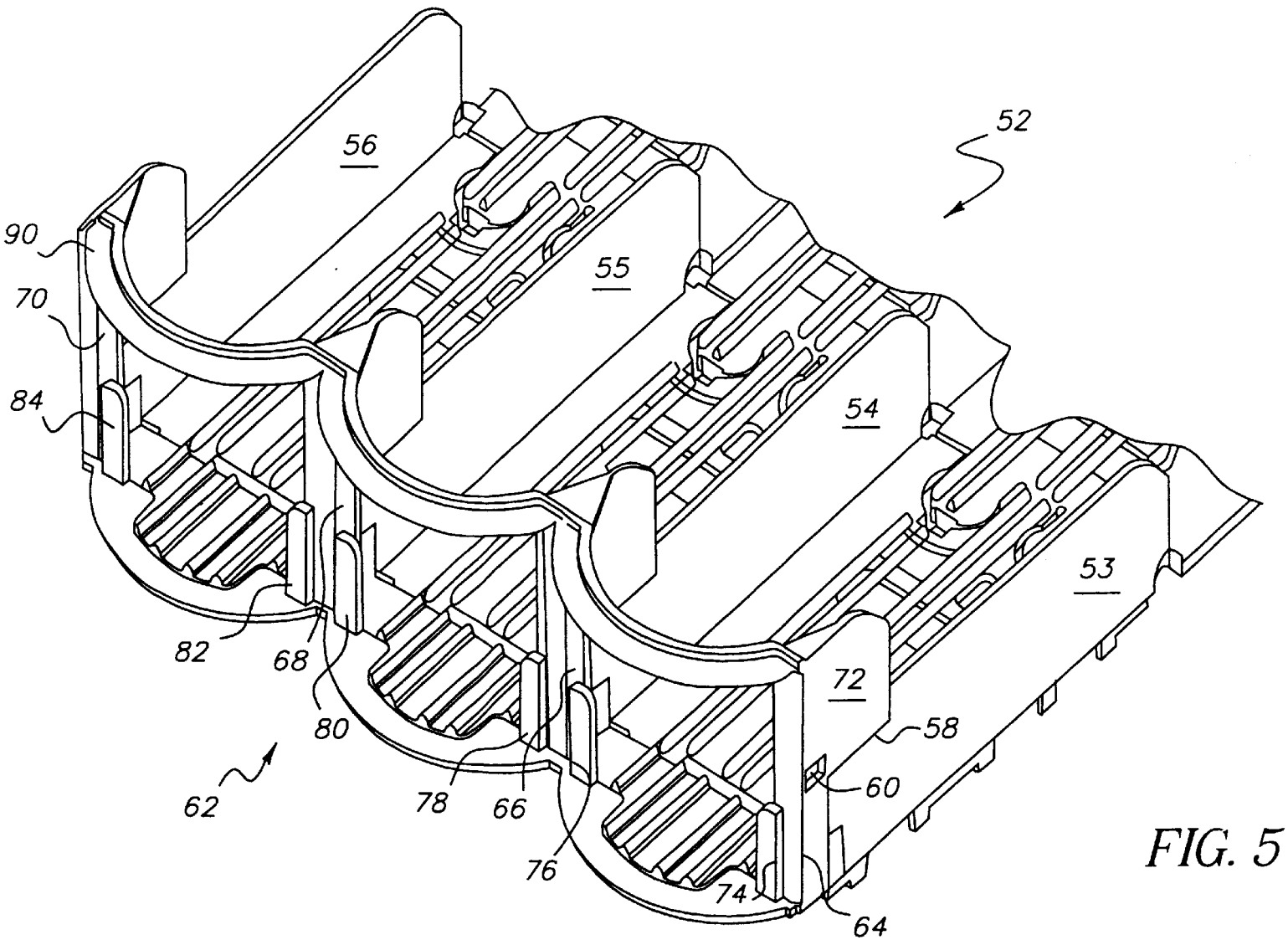
FIG. 5 is a perspective view of another preferred embodiment of a front piece attached to a multi-channel front segment of a track device according to the present invention.

The front panel assembly 10 has a base member with a front edge that is preferably curved or contoured to fit the contour of a beverage container. Front panel assembly 10 is illustrated as having first and second upstanding sidewalls 26, 30 with adjacent sidewalls forming partitions to hold a row of beverage containers therebetween. There may be as few as two sidewalls to accommodate a single row of beverage containers (FIG. 4) or as many sidewalls as are necessary for multiple rows to fill the width of a refrigerator unit (FIG. 5). Each sidewall has a top end portion, a bottom end portion, and a front edge that extends between the top and bottom end portions of the sidewall. Preferably, each sidewall has a protrusion formed 30 on a rear portion thereof for resting in one of the notches 18, 22 to help marry the front panel to the front segment of the track device 12. Each sidewall 26, 30 has a slot or opening to receive one of the upstanding arms 20, 24 therein to help marry the front panel to the front segment of the track device 12.

The first sidewall 26 is connected along its bottom end portion to the base. Second sidewall 30 is laterally spaced from first sidewall 16 and is connected along its bottom end portion to the base. Ideally, the lateral spacing between the first and second sidewalls 26, 30 is slightly greater than the width of the beverage container to be displayed between the sidewalls to allow easy movement of the beverage container while preventing it from tilting askew.

A first face member 34 has a top end portion and a bottom end portion and is connected to the front edge of the first sidewall 26. Face member 34 extends laterally a preselected distance from first sidewall 26 toward second sidewall 30. Face member 34 extends a distance sufficient to interfere with a beverage container to thereby restrain the container from moving forward in the rack.

A second face member 36 has a top end portion and a bottom end portion and is connected the front edge of second sidewall 30. Second face member 36 extends a preselected distance from second sidewall 30 toward first sidewall 26. Face members 34, 36 are preferably connected to base 12 but have sufficient structural integrity when only connected to the sidewalls 26, 30.

Still referring to FIG. 1, an elongated connecting member 38 has a first end connected to the top end portion of first face member 34 and has a second end portion connected to the top end portion of second face member 36. By attaching the elongated connecting member 38 to face members 34 and 36 instead of the sidewalls, a stronger union is obtained because of the larger bonding area where the connecting member and face members meet. Of course, connecting member 38 may be attached to both the face members and sidewalls for the strongest bond. Connecting member 38 curves outward away from face members 34 and 36, and is shaped to fit the contour of a beverage container in the rack. It extends outward over the curved portion of the base wall. Connecting member 38, face members 34 and 36, and the base form a viewing window through which the label of a beverage container can be viewed prior to selection of a beverage from the rack.

A first downwardly extending finger 40 fits into the slot below front segment right sidewall panel 14. Finger 40 has a rearwardly projecting protrusion 42 positioned to engage the underside of the base wall forming a latch that holds the front panel and front segment together. Where the slot is rigid instead of resilient, a corner of the finger 40 opposite projecting protrusion 42 may be truncated so that the finger can fit through the slot and snap into latching contact with the base member. Similarly, a second downwardly extending finger 44 fits into the slot below front segment left sidewall panel 16. Finger 44 has a rearwardly projecting protrusion 46 positioned to engage the underside of the base wall forming a latch that holds the front panel and front segment together.

A first front stop member 48 extends laterally a preselected distance from the first sidewall 26 toward the second sidewall 30, and a second front stop member 50 extends laterally a preselected distance from the second sidewall 30 toward the first sidewall 26. First stop member 48 is shorter than face member 34 and is preferably connected to face member 34 but may be attached to sidewall 26 or to the base wall. Second stop member 50 is shorter than face member 36 and is preferably connected to face member 36 but may be attached to sidewall 30 or to the base wall. The base, face members, connecting member and front stop members define a viewing window for the display track device.

Figure 6:
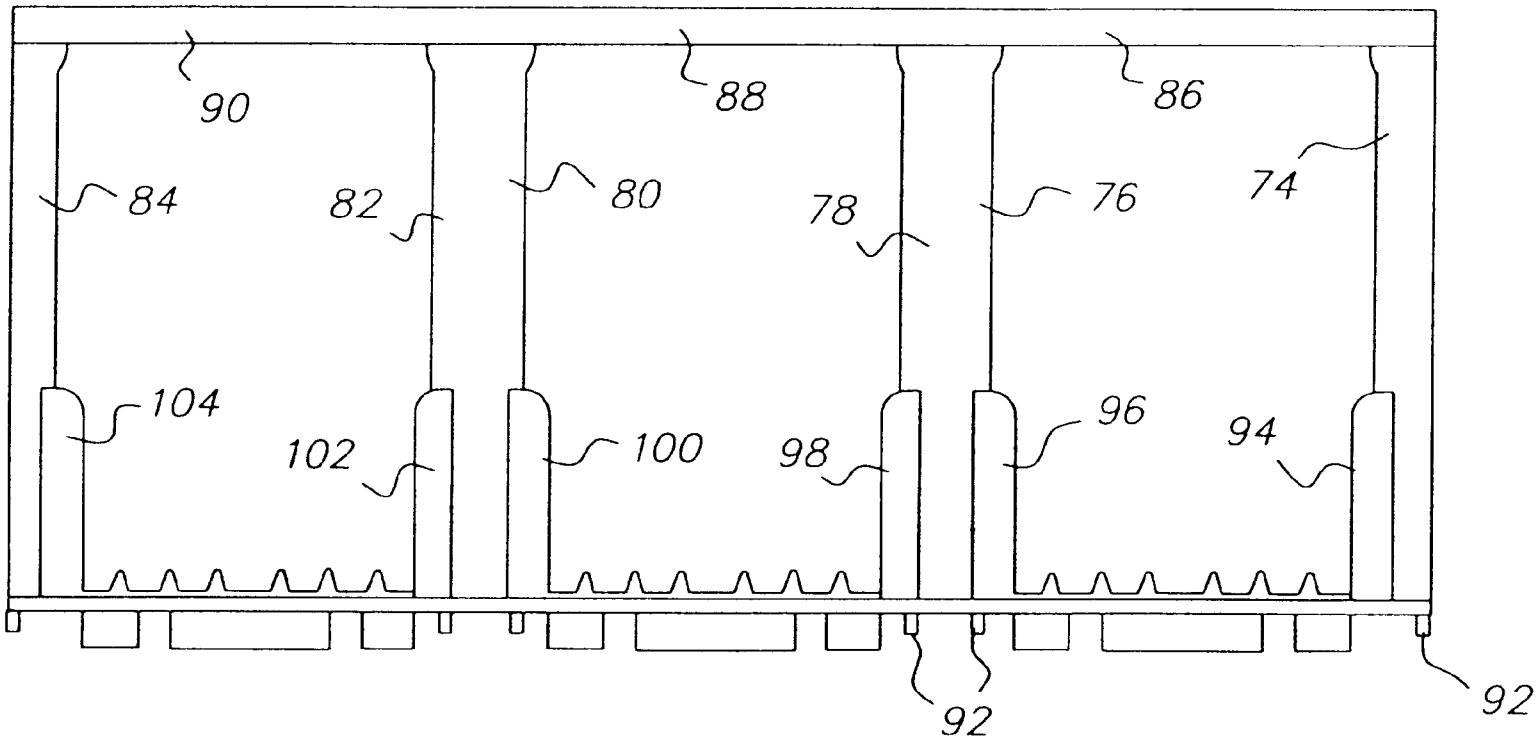
FIG. 6 is a front view of the front piece of FIG. 5.

Referring to FIGS. 5 and 6, a front track segment of track device 52 has a floor or base wall with parallel upstanding sidewalls 53, 54, 55, 56, in this example, forming a three channels, each for a single row of articles to slide along between adjacent sidewalls. Each sidewall panel defines a notch 58 and an upstanding protrusion or arm 60. The front track segment defines a slot below each sidewall panel. The slot is preferably formed of a three sided loop of material attached to the base wall to accept a member forced into it.

The front panel assembly 62 has a base member with a front edge that is preferably curved or contoured to fit the contour of a beverage container. Front panel assembly 62 is illustrated as having four upstanding sidewalls 64, 66, 68, 70 with adjacent sidewalls forming partitions to hold a row of beverage containers therebetween. There may be as many sidewalls as are necessary for multiple rows to fill the width of a refrigerator unit. The sidewalls may be separate with several channels joined together or may be integrally formed with adjacent channels sharing a common sidewall. Each sidewall has a top end portion, a bottom end portion, and a front edge that extends between the top and bottom end portions of the sidewall. Preferably, each sidewall has a protrusion 72 formed on a rear portion thereof for resting in the notch 58 to help marry the front panel to the front segment of the track device. Each sidewall has a slot or opening to receive one of the upstanding arms 60 therein to help marry the front panel 62 to the front segment of the track device 48.

The first sidewall 64 of the front panel assembly 62 is connected along its bottom end portion to the base wall. Second sidewall 66 is laterally spaced from first sidewall 64 and is connected along its bottom end portion to the base wall. Ideally, the lateral spacing between the first and second sidewalls 64, 66 is slightly greater than the width of the beverage container to be displayed between the sidewalls to allow easy movement of the beverage container while preventing it from tilting askew. Third sidewall 68 is similarly laterally spaced from second sidewall 66 and fourth sidewall 70. Second sidewall 66 lies intermediate first and third sidewall 64, 68, and third sidewall 68 lies intermediate second and fourth sidewalls 66, 70.

A first face member 74 has a top end portion and a bottom end portion and is connected to the front edge of the first sidewall 64. Face ember 74 extends laterally a preselected distance from first sidewall 64 toward second sidewall 66. A second face member 76 is connected to the front edge of second sidewall 66. Second face member 36 extends from second sidewall 66 toward first sidewall 64. A third face member 78 is connected to second sidewall 66 adjacent second face member 76. Third face member 78 extends from second sidewall 66 toward third sidewall 68. A fourth face member 80 is connected to third sidewall 68 adjacent a fifth face member 82. Fourth face member 80 extends from third sidewall 68 toward second sidewall 66. Fifth face member 82 extends from third sidewall 68 toward fourth sidewall 70 and sixth face member 84. The face members are preferably connected to the base wall but have sufficient structural integrity when only connected to the sidewalls.

A first elongated connecting member 86 has a first end connected to the top end portion of first face member 74 and has a second end portion connected to the top end portion of second face member 76. Connecting member 86 curves outward away from face members 74 and 76, and is shaped to fit the contour of a beverage container in the rack. It extends outward over the curved portion of the base wall. First connecting member 86, face members 74 and 76, and the base form a viewing window through which the label of a beverage container can be viewed prior to selection of a beverage from the rack. A second elongated connecting member 88 has its ends connected to the top end portions of third and fourth face members 78 and 80. Similarly, a third elongated connecting member 90 has its ends connected to the top end portions of fifth and sixth face members 82 and 80.

Downwardly extending fingers 92 fit into slots below the front segment sidewall panels. The number of fingers is preferably equal to the number of face embers. Each finger 92 has a rearwardly projecting protrusion positioned to engage the underside of the base wall forming a latch that holds the front panel and front segment together. A corner of the finger opposite the projecting protrusion is truncated so that the fingers can fit through the slots more easily.

A first front stop member 94 extends laterally a preselected distance from the first sidewall 64 toward the second sidewall 66, and a second front stop member 96 extends laterally a preselected distance from the second sidewall 66 toward the first sidewall 64. First stop member 94 is shorter than its associated face member 74 and is preferably connected to face member 74 but may be attached to sidewall 64 or to the base wall. Second stop member 96 is shorter than face member 76 and is preferably connected to face member 76 but may be attached to sidewall 66 or to the base wall. The base, face members 74, 76, connecting member 86 and front stop members 94, 96 define a first viewing window for the display track device. The base, face members 78, 80, connecting member 88 and front stop members 98, 100 define a second viewing window adjacent the first viewing window. The base, face members 82, 84, connecting member 90 and front stop members 102, 104 define a third viewing window adjacent the second viewing window.

It can now be appreciated that a front panel assembly for a display track device has been presented. A front panel for a display rack has a base with first and second upstanding sidewalls attached to the base. The sidewalls are connected along their bottom ends to the base. A first face member is connected to the first sidewall and extends laterally toward the second sidewall. A second face member is connected to the second sidewall and extends laterally toward the first sidewall. An elongate connecting member is connect to the tops of the first and second face members. A first front stop member is connected to the first face member and extends laterally a preselected distance from the first sidewall toward the second sidewall. A second front stop member is connected to the second face member and extends laterally a preselected distance from the second sidewall toward the first sidewall. The base, face members, stop members and connecting member define the viewing window for the display track device.

The front panel assembly is attached to the front segment using fingers depending from the front panel that engage slots formed on the front segment. It virtually snaps into position on the rack. The front panel holds a beverage container in position, first for viewing, and then for selection and removal from the rack by a consumer. The container is held upright and forward in the track so that a container is always ready for removal from the rack. The contour of the front panel allows the beverage container to fit forward in the track.

While the invention has been described with particular reference to the preferred embodiments, it will be understood by those skilled in the art that various changes may be made and equivalents may be substituted for elements of the preferred embodiments without departing from invention. For example, a front piece for a multi-channel unit may be a unitary structure or may be several individual front pieces connected using depending gingers to fit into openings in the track device, and may receive arms of the track device into openings to connected the track device and front piece.

As is evident from the foregoing description, certain aspects of the invention are not limited to the particular details of the examples illustrated, and it is therefore contemplated that other modifications and applications will occur to those skilled in the art. For example, the lateral dimensions of the face members may be increased to accommodate narrower containers. It is accordingly intended that the claims shall cover all such modifications and applications as do not depart from the true spirit and scope of the invention.

What is claimed is:

1. A front panel for a display rack, said display rack having a front segment defining first and second slots disposed substantially adjacent a lower forward edge thereof, said front panel comprising:

a base;

a first upstanding sidewall having a top end portion, a bottom end portion and a front edge, said first sidewall being connected along a bottom end portion to said base;

a second upstanding sidewall having a top end portion, a bottom end portion and a front edge, said second sidewall being laterally spaced from said first sidewall and connected along a bottom end portion to said base;

a first face member having a top end portion and a bottom end portion and being connected to said front edge of said first sidewall, said first face member extending laterally a preselected distance from said first sidewall toward said second sidewall;

a second face member having a top end portion and a bottom end portion and being connected to said front edge of said second sidewall, said second face member extending laterally a preselected distance from said second sidewall toward said first sidewall;

an elongate connecting member having a first end connected to said top end portion of said first face member and a second end portion connected to said top end portion of said second face member;

a first finger attached substantially adjacent a lower forward edge of one of said first sidewall and said base and extending downwardly therefrom, said first finger adapted to fit in said first slot to thereby fasten said front panel to said front segment; and a second finger attached substantially adjacent a lower forward edge of one of said second sidewall and said base and extending downwardly therefrom, said second finger being laterally spaced from said first finger and adapted to fit in said second slot to thereby fasten said front panel to said front segment.

2. A front panel, as set forth in claim 1, including:

a first front stop member extending laterally a preselected distance from said first face member toward said second sidewall; and a second front stop member extending laterally a preselected distance from said second face member toward said first sidewall.

3. A front panel, as set forth in claim 2, wherein said base, face members, connecting member and front stop members define a viewing window for said display rack.

4. A front panel, as set forth in claim 2, wherein said first front stop member is attached to said base.

5. A front panel, as set forth in claim 1, wherein said elongate connecting member curves outward away from said face members.

6. A front panel assembly for a display rack, said display rack having a front segment defining at least first and second slots disposed substantially adjacent a lower forward edge thereof, said front panel comprising:

a base;

a first upstanding sidewall having a top end portion, a bottom end portion and a front edge, said first sidewall being connected along a bottom end portion to said base;

a second upstanding sidewall having a top end portion, a bottom end portion and a front edge, said second sidewall being laterally spaced from said first sidewall and connected along bottom end portion to said base;

a third upstanding sidewall having a top end portion, a bottom end portion and a front edge, said third sidewall being laterally spaced from said second sidewall and connected along a bottom end portion to said base, said second sidewall being intermediate said first and third sidewalls;

a first face member having a top end portion and a bottom end portion and being connected to said front edge of said first sidewall, said first face member extending laterally a preselected distance from said first sidewall toward said second sidewall;

a second face member having a top end portion and a bottom end portion and being connected to said front edge of said second sidewall, said second face member extending laterally a preselected distance from said second sidewall toward said first sidewall and extending laterally a preselected distance from said second sidewall toward said third sidewall;

a third face member having a top end portion and a bottom end portion and being connected to said front edge of said third sidewall, said third face member extending laterally a preselected distance from said third sidewall toward said second sidewall;

a first elongate connecting member having a first end connected to said top end portion of said first face member and a second end portion connected to said top end portion of said second face member, said base, face members and connecting member defining a first viewing window for said display rack;

a second elongate connecting member having a first end connected to said top end portion of said second face member and a second end portion connected to said top end portion of said third face member, said base, face members and connecting member defining a second viewing window for said display rack; and at least first and second fingers, said first finger being attached substantially adjacent a lower forward edge of one of said base and first, second and third sidewalls, said first finger extending downwardly therefrom, said first finger being adapted to fit in said first slot to thereby fasten said front panel to said front segment, said second finger being attached substantially adjacent a lower forward edge of one of said base and first, second and third sidewalls, said second finger extending downwardly therefrom and being laterally spaced from said first finger, said second finger being adapted to fit in said second slot to thereby fasten said front panel to said front segment.

7. A front panel, as set forth in claim 6, including:

a first front stop member extending laterally a preselected distance from said first face member toward said second sidewall; and a second front stop member extending laterally a preselected distance from said second face member toward said first sidewall;

a third front stop member extending laterally a preselected distance from said third face member toward said third sidewall; and a fourth front stop member extending laterally a preselected distance from said fourth face member toward said second sidewall.

8. A front panel, as set forth in claim 7, wherein said base, first and second face members, first connecting member and first and second front stop members define a first viewing window for said display rack.

9. A front panel, as set forth in claim 7, wherein said base, second and third face members, second connecting member and third and fourth front stop members define a second viewing window for said display rack.

10. A front panel, as set forth in claim 7, wherein said front stop members are attached to said base.

11. A front panel, as set forth in claim 6, wherein said elongate connecting members curve outward away from said face members.

* * * * *